United States Patent [19]

Chatfield

[11] 4,000,009

[45] Dec. 28, 1976

[54] WROUGHT PURE GRADE ALUMINUM ALLOY AND PROCESS FOR PRODUCING SAME

[75] Inventor: David A. Chatfield, Coraopolis, Pa.

[73] Assignee: National Steel Corporation, Pittsburgh, Pa.

[22] Filed: Mar. 26, 1975

[21] Appl. No.: 562,195

[52] U.S. Cl. ..... 148/2; 148/3; 148/11.5 A; 148/12.7 A

[51] Int. Cl.[2] ..... B22D 11/06; C22F 1/04

[58] Field of Search ..... 148/2, 3, 11.5 A, 12.7; 164/88

[56] References Cited

UNITED STATES PATENTS

| | | | |
|---|---|---|---|
| 2,249,353 | 7/1941 | Fritzlen | 148/11.5 A |
| 2,790,216 | 4/1957 | Hunter | 164/88 |
| 3,304,208 | 2/1967 | Jager | 148/11.5 A |

*Primary Examiner*—W. Stallard

*Attorney, Agent, or Firm*—Shanley, O'Neil and Baker

[57] ABSTRACT

Pure aluminum alloy which has been continuously cast and partially worked to a strip at a gauge of 0.25 inches through use of a Hunter-Caster, is heated to a temperature in a range of about 900° to about 1150° F. and then subjected to slow cooling in a range between cooling at around 600° F./hr. as a maximum, and cooling at a rate of 25° F./hr. as a practical minimum, until ambient temperature or about 100° F. is reached. After cooling, the alloy strip is subjected to cold working and annealing until a desired gauge is reached for a particular product, one typical product being aluminum foil. In one process according to the invention, the strip is heated as it leaves a Hunter-Caster and then coiled, and the cooling is effected by leaving the coil in ambient air. In another process, it is coiled prior to heating which is then effected by placing the coil in a suitable furnace such as in box annealing. The coil is then cooled in the furnace, either as the furnace cools naturally or at a slower, controlled cooling rate. In another preferred process the alloy strip produced by the Hunter-Caster is subjected to conventional cold working until a suitable gauge, for example, 0.050 inches is reached. At this point, rather than subjecting the alloy to a conventional annealing process, it is subjected to the heat treatment and slow cooling described after which it is then cold worked further and subjected to a final stress relieving anneal at approximately 400° F. The heating and slow cooling of the present invention improve the ductility and recrystallization kinetics of wrought pure aliminum produced through continuous casting, cold rolling and annealing.

44 Claims, No Drawings

WROUGHT PURE GRADE ALUMINUM ALLOY AND PROCESS FOR PRODUCING SAME

BACKGROUND OF THE INVENTION

The present invention broadly relates to wrought aluminum alloy of the "super pure" or "pure" grade which range in composition from a minimum of 99.00% aluminum (alloy 1100) to a maximum of 99.99% aluminum (alloy 1199) and thus contain no major alloying element. For a more detailed description of such alloys and their designations and properties, reference may be had to the text, ALUMINUM, Volume 1, pages 303 through 313 by American Society of Metals 1967, edited by Kent R. VanHorn which is hereby incorporated by reference into this application. While in one commercial preferred application, the invention is directed to 1145 aluminum alloy (99.45% aluminum), commonly used for producing aluminum foil, the invention may also be applicable to other pure or super pure grade alloys described above.

It is an established fact that pure aluminum alloy such as 1145 alloy as conventionally produced through continuous casting in strip form is generally harder and thus less ductile and more difficult to recrystallize during annealing following cold working than the same alloy made by the more conventional "direct-chill" casting method. Aluminum alloy ingots produced by the direct chill casting method are typically cast in heavy sections, hot rolled and then subjected to various cold rolling and annealing cycles until the desired final gauge is reached. This process has been satisfactorily applied in the commercial production of aluminum foil from pure grade aluminum alloy. However in contrast, commercial production of the same foil from the same pure grade alloy through use of a continuous strip casting method utilizing the same cold working and annealing procedures has been found to be more difficult due to the hardness and recrystallization problems mentioned above. As a result, the wrought product must be subjected to additional cold working and annealing and also at times at higher annealing temperatures when compared to a product of the direct chill casting process.

OBJECTS OF INVENTION

It is therefore a broad object of the present invention to overcome the above noted problem by improving the ductility of pure grade wrought aluminum alloy originally produced through continuous strip casting so as to enhance its recrystallization and recovery properties during annealing following cold working. Included herein is such an improvement as will, for example, render a continuously cast pure aluminum wrought alloy on a par with the same alloy produced through the more conventional direct chill process.

A further object of the present invention is to provide an improved process for treating continuously cast aluminum alloy strip of pure grade in connection with cold working and annealing to improve the ductility and recrystallization properties thereof. Included herein is such a process that is suitable for commercial use and moreover may be employed in conjunction with conventional process strips for forming aluminum sheet or foil from continuously cast strip such as, for example, effected through a Hunter-Caster such as disclosed in U.S. Pat. No. 2,790,216, issued Apr. 30, 1957.

A more specific object of the present invention is the provision of 1145 Hunter-cast wrought aluminum product having improved ductility, and a novel process for producing the same.

Another more specific object is the provision of a novel process for use in reducing continuously cast strip aluminum alloy of pure or super pure grade to foil gauge. Included herein is such a process that will not adversely affect the grain size in the foil product so as to avoid streaked matte surface effects or similar undesirable blemishes.

SUMMARY OF INVENTION

In one commercial process, the aforementioned-Hunter-cast process, of continuously casting aluminum alloy shapes, the aluminum aforementioned Hunter-cast emerges from the bite of a pair of closely spaced counter-rotating rollers in strip, sheet or plate form with a maximum thickness of approximately 0.25 inches. Because of this gauge, coupled with the fact that the rollers are cooled to remain at a temperature of about 170° F., the emerging shape is sharply reduced in temperature from about 1300° to below 600° F. in less than 30 seconds. It is believed that such rapid cooling when casting pure grade aluminum alloy shapes results in entrapment of impurities in solution which give rise to the aforementioned problems encountered when the shape is subsequently cold worked and annealed.

In accordance with the present invention, the shape after being formed by the caster is subjected to a heat treatment at a temperature preferably in the range of 900° to 1150° F. The shape is then subjected to slow or controlled cooling preferably to ambient atmospheric temperature or about 100° F. at a predetermined cooling rate dependent upon the composition of the strip. Additionally, the rate of cooling may vary in accordance with the temperature to which the shape is subjected prior to cooling and in some cases upon the duration for which the shape is held at that temperature. The rate may be between cooling at about 600° F. per hour as a maximum and controlled cooling, such as in a furnace, at a rate of, e.g., 25° F. per hour as a practical minimum; the optimum cooling rate being in the neighborhood of 350° F. per hour.

Such heating and controlled or slow cooling permits the entrapped impurities to precipitate out in sufficiently large size as will not interfere with subsequent recrystallization of the grain structure during subsequent cold working and annealing treatments. The shape may be held at the elevated temperature for a soak period of up to about 8 hours. The increased temperature to which the shape is subjected must be sufficiently high to provide complete solution of the entrapped impurities. Additionally, the heat treatment serves a secondary purpose of redissolving or placing into solution, precipitates that may be formed prior to the heating step. However, while the temperature should be sufficiently high as indicated above, it has been discovered that it should not exceed a certain limit since this could have an opposite detrimental effect of inhibiting recrystallization and decreasing ductility. One possible theory in explanation of the latter, "reversal" effect, is that heat treatment above a maximum temperature allows another species of impurities or precipitates to become dissolved in solution which upon subsequent working and annealing at a lower temperature, precipitate in a size that would prevent complete recrystallization. Another theory is that the excessive temperature may cause more rapid nucleation and growth of another phase of impurities or precipitates to the point where too much second phase impurities or precipitates are present to permit complete recrystallization at lower annealing temperatures.

In one process according to the invention that would be admirably suited for use in existing commercial production, the aluminum shape which can be in the form of sheet or strip is heated to the desired temperature described above just ahead of a conventional coiling step wherein the aluminum strip is wound into a coil. The slow cooling step is then effected by simply allowing the coil to cool in ambient atmosphere. In another process, which may be employed where oxidation of the surface of a sheet is to be avoided, the strip upon emergence from the continuous casting apparatus is coiled and then placed into a suitable or conventional furnace, such as used in box annealing, where it is subjected to the desired elevated temperature and subsequently cooled at the predetermined controlled rate.

After the heat treatment and slow or controlled cooling is effected in accordance with either of the above specific processes, the sheet is then subsequently cold worked and annealed which may be accomplished in conventional manner such as used for direct-chill products, until the desired foil gauge is reached. During the latter steps, complete recrystallization will be achieved and the ductility of the product improved. The subsequent cold working after the heat treatment and cooling steps, may be effected using the same conventional procedures as used in reducing direct chilled material to foil gauge. Such procedures include an intermediate anneal such as at a temperature of about 650° F. and conclude with a final "stress-relief anneal" such as at a temperature of around 400° F. However, in order to achieve the improved ductility properties of the present invention, it is important that the strip not be subjected to a second heat treatment at the same elevated temperatures as the first heat treatment and then subjected to a sharp or rapid cooling rate. It has been found that such reheating and rapid cooling would reverse the beneficial effects of the prior slow cooling and would result in retardation of recrystallization and low ductility. Therefore, the annealing temperatures must be limited accordingly, as is desirable, to those such as 650° to 700° F. conventionally employed, for example, in cold working and annealing of direct chill cast material.

In the preferred process for carrying out the present invention, rather than applying the heat treatment either prior or subsequent to the step of coiling the strip emerging from the continuous caster, the heat treatment and controlled cooling are applied to the strip in substitution for the intermediate annealing step which is conventionally effected after a cold reduction step. Other than this novel substitution, the process of producing foil from a continuous cast strip may be the same as that heretofore employed for direct chill cast products without sacrificing ductility in the cold worked and annealed product.

DETAILED DESCRIPTION

The present invention is directed to wrought aluminum alloys of pure or super pure grade and it is noted at the outset that the term "wrought" is an accepted trade designation indicating that the alloy shape is in the form of a worked product such as, for example, plate, strip, sheet or foil. Under one classification system presently utilized in the trade, aluminum that is 0.250 inches or more in thickness is classified as plate; sheet is 0.006 to 0.249 inches in thickness; and foil ranges in thickness from 0.00017 to 0.0059 inches in thickness (see pages 37 and 42, ALUMINUM, Volume 2, American Society of Metals).

Inasmuch as the present invention is highly suited for use in producing commercial aluminum foil, the description below in certain aspects will relate to such commercial foil production for purposes of illustration. However, it will be understood that the present invention is also applicable to the production of aluminum alloy sheet or other wrought shapes wherein the composition of the aluminum alloy is of pure or super pure grade which ranges in composition from a minimum of 99.00% aluminum to the maximum of 99.99% aluminum and contains no major alloying element. Other elements most commonly included in such grade are silicon, iron, copper, titanium and boron. In addition, there may be included magnesium, manganese, nickel, and zinc. However, none of these other elements will be present in a content more than about 0.5% by weight of the total composition. As can be seen, the total amount of these other element impurities is insufficient to contribute any significant alloying characteristics to the aluminum and hence the designation pure or super pure grade is applied.

In the commercial production of aluminum foil, the most commonly used aluminum alloy is 1145 which contains 99.45% aluminum and with the remainder including, for example, 0.085 silicon, 0.365 iron, 0.034 copper, 0.02 titanium, and 0.0050 boron. The latter aluminum composition moreover is typical of that which has been commercially used in producing aluminum foil through means of a continuous strip casting process to which the present invention in a specific commercial application is particularly directed. Such continuous strip casting process is in contrast to the more conventional direct chill process previously and presently used in the production of wrought aluminum alloy, including aluminum foil. For purposes of illustration and in one specific commercial application, the preferred continuous casting process is that known or referred to as the Hunter-cast process which is disclosed in U.S. Pat. No. 2,790,216, issued Apr. 30, 1956 to J. L. Hunter. The apparatus for carrying out the Hunter-cast process may be termed a "Hunter-Caster" and is also disclosed in said U.S. Pat. No. 2,790,216, the disclosure of which is incorporated by reference herein to aid in the understanding of the present invention, if necessary.

In one prior commercial process of producing aluminum foil through the use of a continuous strip casting process utilizing a Hunter-Caster, 1145 aluminum alloy issues from between a pair of counter-rotating rollers of the Hunter-Caster in the form of a strip having a thickness of about 0.25 inches which, of course, is determined by the spacing between the rollers which work the aluminum to that gauge. The strip is then coiled for handling prior to further processing which includes cold rolling the strip to an 89% reduction to a gauge of 0.029 inches. Then the strip is annealed in the vicinity of 650° to 700° F. Subsequently, the strip is again cold rolled to a reduction of approximately 98% to a gauge of approximately 0.00054 inches. The strip is next subjected to a stress relieving anneal at approximately 400° F. and finally subjected to further cold rolling to reduce the strip to the desired foil gauge.

In contrast to similar processing of an aluminum strip of the same grade previously formed by direct chill casting, the aforementioned cold working and annealing of the strip formed through the Hunter-cast process is more difficult to achieve, requiring additional cold rolling as well as additional anneals and sometimes, higher temperature anneals. As stated above, it is believed that the reason for this difficulty is due to the hardness and sluggish recrystallication characteristics of the strip resulting from the sharp reduction in temperature undergone by the strip as it leaves the Hunter-Caster at a gauge of approximately 0.25 inches. In contrast, strips produced from ingots resulting from the direct-chill casting method do not suffer the same problems, since these ingots are cast in heavy sections and are not subjected to the sharp temperature reduction which is inherent in the aforementioned continuous casting to a low gauge such as 0.25 inches. As a theory, it is believed that the sharp reduction in temperature of the strip from about 1300° to below 600° F. causes the entrapment of impurities in solution in the strip which, upon subsequent conventional cold working and annealing, precipitate in such small size as to render the strip too hard and insufficiently ductile.

In accordance with the present invention, after continuous casting to a gauge of approximately 0.25 inches, the aluminum strip is heated to a temperature in the range of approximately 900° to approximately 1150° F. Then the heated strip is subjected to slow or controlled cooling at a predetermined rate which may vary between a maximum rate of cooling of about 600° F. per hour to a practical minimum rate of 25° F. per hour of linear cooling. Such a slow cooling rate is important since it permits inpurities entrapped in solution to precipitate out in a large size such as will not adversely affect recrystallization during subsequent cold working and annealing treatments of the strip. The heat treatment prior to cooling must be sufficiently high so as to provide sufficient cooling time to permit the impurities to precipitate in large size and also as a secondary purpose to cause redissolution of precipitates previously formed prior to the heating step. However, it has also been found that the temperature of the heat treatment should not be excessively above 1150° F. since this causes other problems that have the opposite detrimental effect, namely of inhibiting recrystallization and decreasing ductility of the cold worked annealed strip.

While it has been found that if the strip during the heat treatment is held at the desired temperature for a period of time the benefits to be achieved in obtaining complete recrystallization can be improved, it has also been found that the same general benefits can also be achieved in certain cases where the heat strip is not held at the desired temperature for any prolonged time but rather is subjected to the desired cooling immediately upon arriving at the desired temperature of heat treatment.

The rate of cooling after the heat treatment is important and may be varied within the range indicated depending upon the specific aluminum alloy composition within the pure or super pure grade.

The desired slow cooling may be effected either in ambient air or in a furnace utilized to previously heat the strip to the desired heat treatment temperature. In the latter case, cooling may be achieved by either terminating the supply of heat in the furnace and allowing the strip to cool therein or by specifically programing the cooling in the furnace so as to achieve a linear cooling rate, for example, between a practical lower limit of 25° F. per hour and 50° F. per hour. For best results in improving ductility, theoretically, the lowest possible cooling rates are preferred. However, practical considerations such as capital investment in equipment needed for cooling dictate a compromise optimum cooling rate in commercial production of between approximately 250° and 350° F. per hour.

The heat treatment and slow cooling of the present invention may be applied either before the conventional cold working and annealing steps outlined above or during the latter in substitution for an intermediate annealing step, the latter being the preferred method. In applying the heat treatment and slow cooling prior to the conventional cold working and annealing steps, in a typical commercial operation, the strip after being cast to a 0.25 inch gauge is heated in the range of 900° to 1150° F., then coiled and simply left to cool in ambient air. Upon conclusion of the cooling, the strip of course is uncoiled and subjected to the conventional cold working and annealing steps described above. An alternative in this process would be to first coil the strip at 0.25 inch gauge, for example, and then place the coil in a furnace for heat treatment to the desired temperature. The cooling would then be effected while the coil is in the furnace by either of the methods described above. Subsequently, the coil would be further cold worked with annealing to the final gauge.

In the preferred process of the invention, the 0.25 inch strip, after being formed by a Hunter-Caster, is subjected to conventional cold rolling until it reaches, for example, a gauge of approximately 0.050 inches. Then instead of applying a conventional annealing step at 650° to 700° F., the strip is subjected to the heat treatment in the range of 900° to 1150° F. after which it is slowly cooled in accordance with the invention. The strip is then subjected to further cold rolling including a stress-relieving anneal at about 400° F. until the final desired gauge is reached. Not only does this process involve lesser steps while being easily implemented in the line of conventional or commercial foil producing apparatus, but furthermore it ensures against the formation of a streaked matte surface in the finished foil.

The invention may further be illustrated by reference to the specific examples outlined in Table A below disclosing the conditions and results of processing seven strips of 1145 aluminum alloy previously formed through the Hunter-cast process and each having the same gauge, 0.25 inches, and the following composition: silicon 0.085, iron 0.365, copper 0.034, titanium 0.02, boron 0.0050, and the remainder being aluminum.

TABLE A

| Example | Soak Temperature (° F) | Soak Time (hrs) | Cooling Rate* | Cold Reduction (%) | Annealing Temperature (° F) | Annealing Time (hrs) | Tensile Strength (psi) | Total Elongation (% in 2") |
|---|---|---|---|---|---|---|---|---|
| 1 | | CAST | | 89 | 650 | 0.5 | 17,500 | 10.9 |
| 2 | 950 | 0 | 2 | 89 | 650 | 0.5 | 11,700 | 31.2 |
| 3 | 1050 | 0 | 2 | 89 | 650 | 0.5 | 11,100 | 31.0 |
| 4 | 1050 | 1 | 2 | 89 | 650 | 0.5 | 9,100 | 30.8 |
| 5 | 1050 | 2 | 4 | 89 | 650 | 0.5 | 11,200 | 33.0 |
| 6 | 1050 | 2 | 3 | 89 | 650 | 0.5 | 11,800 | 35.2 |
| 7 | 1050 | 8 | 2 | 89 | 650 | 0.5 | 12,100 | 33.3 |

*Cooling Rates
1. Cooling in ambient air
2. Cooling in [Temper Rite brand] furnace
3. Programmed 25° F./Hr linear cooling
4. Programmed 50° F./Hr linear cooling The first example listed in Table A is a conventionally processed strip of previously Hunter-cast material, and its ductility measured after a cold rolled reduction of 89% to 0.029 inches in gauge and annealing, is indicated by the "total elongation" factor and also by the tensile strength which is inversely proportional to ductility. The remaining examples in the table illustrate processes for treating the strip material in accordance with the present invention and the results listed in the table indicate an increase in the ductility of the strip when measured at the same stage after heating and cooling (in accordance with the invention), cold reduction to the same gauge, and annealing.

It will be understood that where a cooling rate is referred to in this specification and appended claims, the cooling rate named is the average cooling rate over the period of time involved in dropping the temperature from the heat treating temperature to a desired lower temperature, the rate being somewhat higher in the region of higher temperature and somewhat lower in the region of lower temperature.

It will further be noted that different ductility indications may be obtained depending upon the soak temperature and the cooling rate employed. In this regard, Examples 5 and 6 may be compared to each other. Additionally, Example 7 which was held to a soak temperature for eight hours shows an improvement in ductility over Example 4 which was held to a soak temperature for one hour. Finally, it is noted that all of the examples treated in accordance with the present invention were subject to the intermediate anneal at the same temperature 650° F. subsequent to cold reduction after heat treatment and cooling steps.

I claim:

1. In a process of producing a wrought sheet of aluminum alloy of the class of pure and super pure grade containing not less than 99.00% aluminum wherein the molten alloy is continuously cast to form a sheet and the sheet cold reduced and annealed; the steps comprising: heating the continuously cast sheet to a temperature in the range of approximately 900° to 1150° F. after the sheet has been continuously cast to a first thickness gauge, and then cooling the heated continuously cast sheet at a rate not greater than a rate of cooling of about 600° F. per hour so as to precipitate impurities in such a size as will result in desired recrystallization of the grain structure of the sheet thereby to enhance the ductility of the alloy upon cold working and annealing of the sheet.

2. The process defined in claim 1 wherein the cooling rate is not greater than approximately 350° F. per hour and not less than about 25° F. per hour.

3. The process defined in claim 1 wherein after the sheet has been continuously cast to the first thickness gauge, the sheet is coiled, and wherein said heating and cooling are imparted to the coiled sheet after which the coil is unwound and the sheet reduced further in gauge by cold working and then is annealed.

4. The process defined in claim 3 wherein the heated coiled sheet is cooled at a rate not greater than approximately 350° F. per hour and not less than approximately 25° F. per hour.

5. The process defined in claim 1 wherein the continuously cast sheet is formed of 1145 aluminum alloy and wherein the continuously casting is effected by means of a Hunter-Caster.

6. The process defined in claim 1 wherein after the sheet is heated the sheet is coiled and said cooling is effected by holding the coiled sheet in ambient air and wherein after cooling the coiled sheet is unwound and the sheet further cold worked to reduce its gauge and annealed.

7. The process defined in claim 1 wherein after the sheet is continuously cast to said first thickness gauge, the sheet is further reduced to a second gauge by cold working and wherein said heating and cooling steps are applied to the sheet in the second gauge condition after which the sheet is subjected to another cold reduction followed by said annealing to relieve stresses.

8. The process defined in claim 7 wherein the first gauge is approximately 0.25 inches and the second gauge is approximately 0.050 inches and wherein the stress relief annealing step is conducted at a temperature of 400° F.

9. The process defined in claim 8 wherein the continuously cast sheet is formed of 145 aluminum alloy and wherein the continuous casting is effected by means of a Hunter-Caster.

10. The process defined in claim 7 wherein the cooling rate is not greater than approximately 350° F. per hour and not less than about 25° F. per hour.

11. The process defined in claim 8 wherein after the annealing step the sheet is further cold reduced to foil gauge.

12. The process defined in claim 1 wherein the sheet is cooled to a temperature of approximately 100° F. in the cooling step.

13. The process defined in claim 1 wherein after cooling the sheet is cold worked further to reduce its gauge then subjected to said annealing at a temperature of about 650° to 700° F.

14. The process defined in claim 13 wherein after annealing the sheet is further cold worked to further reduce its gauge and then is annealed again at a temperature of about 400° F. to relieve stresses.

15. The process defined in claim 14 wherein after the last defined annealing step the sheet is further cold reduced to foil gauge.

16. The process defined in claim 1 wherein the sheet is held at said temperature for a period of time up to eight hours prior to cooling.

17. The process defined in claim 2 wherein after the sheet has been continuously cast to the first thickness gauge, the sheet is coiled, and wherein said heating and cooling are imparted to the coiled sheet after which the coil is unwound and the sheet reduced further in gauge by cold working and then is annealed.

18. The process defined in claim 2 wherein the sheet is formed of 1145 aluminum alloy and wherein the continuous casting is effected by means of a Hunter-Caster.

19. The process defined in claim 2 wherein after the sheet is heated the sheet is coiled and said cooling is effected by holding the coiled sheet in ambient air and wherein after cooling the coiled sheet is unwound and the sheet further cold worked to reduce its gauge and annealed.

20. The process defined in claim 2 wherein after the sheet is continuously cast to said first thickness gauge, the sheet is further reduced to a second gauge by cold working and wherein said heating and cooling steps are applied to the sheet in the second gauge condition after which the sheet is subjected to another cold working followed by said annealing to relieve stresses.

21. The process defined in claim 20 wherein the first gauge is approximately 0.25 inches and the second gauge is approximately 0.050 inches and wherein the stress relief annealing step is conducted at a temperature of 400° F.

22. The process defined in claim 2 wherein the sheet is cooled to a temperature of approximately 100° F. in the cooling step.

23. A continuously cast aluminum alloy sheet of improved ductility produced by the process of claim 1.

24. A continuously cast aluminum alloy sheet of improved ductility produced by the process of claim 2.

25. A cold reduced and annealed aluminum alloy sheet of improved ductility produced by the process of claim 3.

26. A cold reduced and annealed aluminum alloy sheet of improved ductility produced by the process of claim 4.

27. A continuously cast aluminum alloy sheet of improved ductility produced by the process of claim 5.

28. A cold reduced and annealed aluminum alloy sheet of improved ductility produced by the process of claim 6.

29. A cold reduced and annealed aluminum alloy sheet of improved ductility produced by the process of claim 7.

30. A cold reduced and annealed aluminum alloy sheet of improved ductility produced by the process of claim 8.

31. A cold reduced and annealed aluminum alloy sheet of improved ductility produced by the process of claim 9.

32. A cold reduced and annealed aluminum alloy sheet of improved ductility produced by the process of claim 10.

33. An aluminum alloy foil of improved ductility produced by the process of claim 11.

34. A continuously cast aluminum alloy sheet of improved ductility produced by the process of claim 12.

35. A cold reduced and annealed aluminum alloy sheet of improved ductility produced by the process of claim 13.

36. A cold reduced and annealed aluminum alloy sheet of improved ductility produced by the process of claim 14.

37. An alumunim alloy foil of improved ductility produced by the process of claim 15.

38. A continuously cast aluminum alloy sheet of improved ductility produced by the process of claim 16.

39. A cold reduced and annealed aluminum alloy sheet of improved ductility produced by the process of claim 17.

40. A continuously cast aluminum alloy sheet of improved ductility produced by the process of claim 18.

41. A cold reduced and annealed aluminum alloy sheet of improved ductility produced by the process of claim 19.

42. A cold reduced and annealed aluminum alloy sheet of improved ductility produced by the process of claim 20.

43. A cold reduced and annealed aluminum alloy sheet of improved ductility produced by the process of claim 21.

44. A continuously cast aluminum alloy sheet of improved ductility produced by the process of claim 22.

* * * * *